US009267475B2

(12) United States Patent
Noguchi

(10) Patent No.: US 9,267,475 B2
(45) Date of Patent: Feb. 23, 2016

(54) NOZZLE PLATE FOR FUEL INJECTION DEVICE

(71) Applicant: Enplas Corporation, Saitama (JP)

(72) Inventor: Koji Noguchi, Saitama (JP)

(73) Assignee: ENPLAS CORPORATION, Saitama (JP)

( * ) Notice: Subject to any disclaimer, the term of this patent is extended or adjusted under 35 U.S.C. 154(b) by 0 days.

(21) Appl. No.: 14/475,771

(22) Filed: Sep. 3, 2014

(65) Prior Publication Data

US 2015/0060572 A1 Mar. 5, 2015

(30) Foreign Application Priority Data

Sep. 4, 2013 (JP) ..... 2013-182850

(51) Int. Cl.
*F02M 61/16* (2006.01)
*F02M 61/18* (2006.01)

(52) U.S. Cl.
CPC ..... *F02M 61/162* (2013.01); *F02M 61/166* (2013.01); *F02M 61/168* (2013.01); *F02M 61/1853* (2013.01); *F02M 2200/8046* (2013.01); *F02M 2200/9015* (2013.01); *F02M 2200/9092* (2013.01)

(58) Field of Classification Search
CPC F02M 61/162; F02M 61/163; F02M 61/1853
USPC ..... 239/463, 468–470, 487, 488, 494, 497, 239/533.2, 533.12, 596
See application file for complete search history.

(56) References Cited

U.S. PATENT DOCUMENTS

| | | | | |
|---|---|---|---|---|
| 5,899,390 | A * | 5/1999 | Arndt et al. | 239/553 |
| 7,066,408 | B2 * | 6/2006 | Sugimoto et al. | 239/533.12 |
| 2004/0104285 | A1 * | 6/2004 | Okamoto et al. | 239/533.12 |
| 2009/0200403 | A1 * | 8/2009 | Hung et al. | 239/533.12 |
| 2009/0230219 | A1 * | 9/2009 | Matsumura et al. | 239/533.12 |

FOREIGN PATENT DOCUMENTS

| | | |
|---|---|---|
| JP | 10-122097 | 5/1998 |
| JP | 2004-239142 | 8/2004 |

* cited by examiner

*Primary Examiner* — Darren W Gorman
(74) *Attorney, Agent, or Firm* — Wenderoth, Lind & Ponack, L.L.P.

(57) ABSTRACT

In a nozzle plate for a fuel injection device which can inject fuel flowed out from a fuel injection port of the fuel injection device in a sufficiently atomized state, a portion of fuel which flows in the inside of a nozzle hole impinges on an interference element, is sharply bent so as to flow backward by an impinging surface of the interference element which is formed of an annular recessed surface, is made to impinge on fuel which intends to advance straightly and pass through the nozzle hole and the orifice, and forms the flow of the fuel which intends to advance straightly and pass through the nozzle hole and the orifice into a turbulent flow. As a result, the nozzle plate for a fuel injection device further enhances the level of the atomization of fuel.

11 Claims, 13 Drawing Sheets

( a ) ( b )

(a)
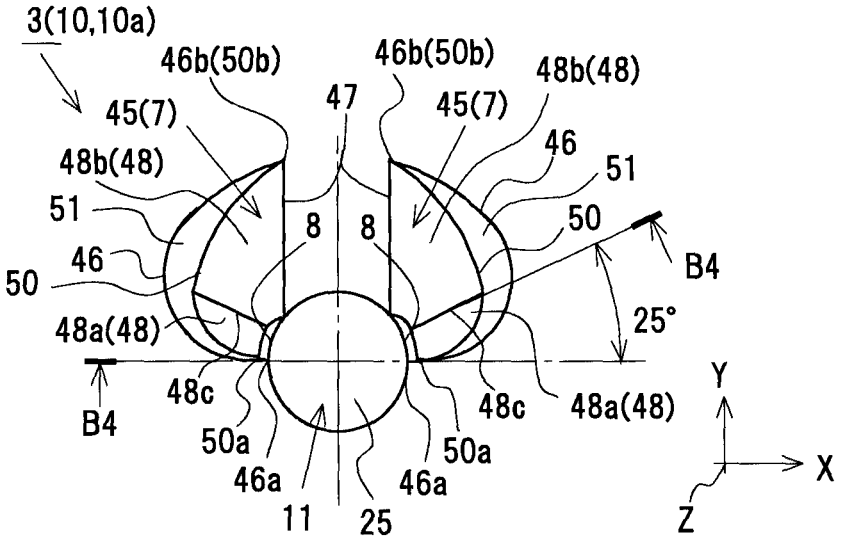
(b)
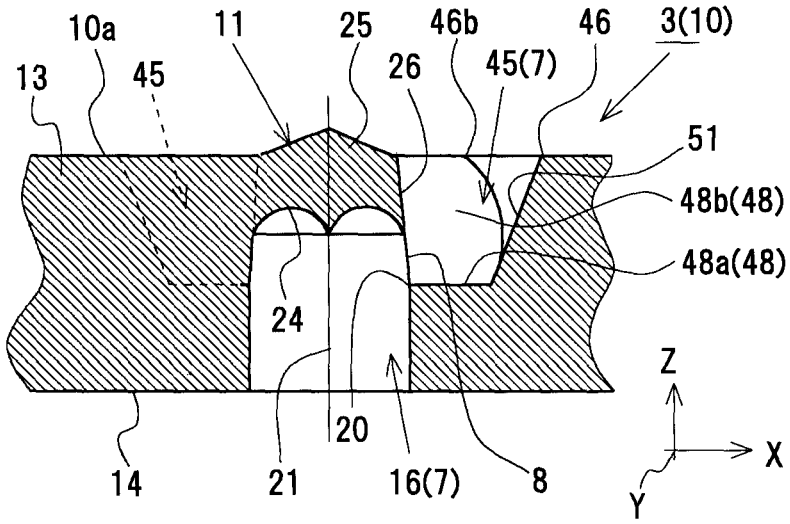
Fig. 9

(a)
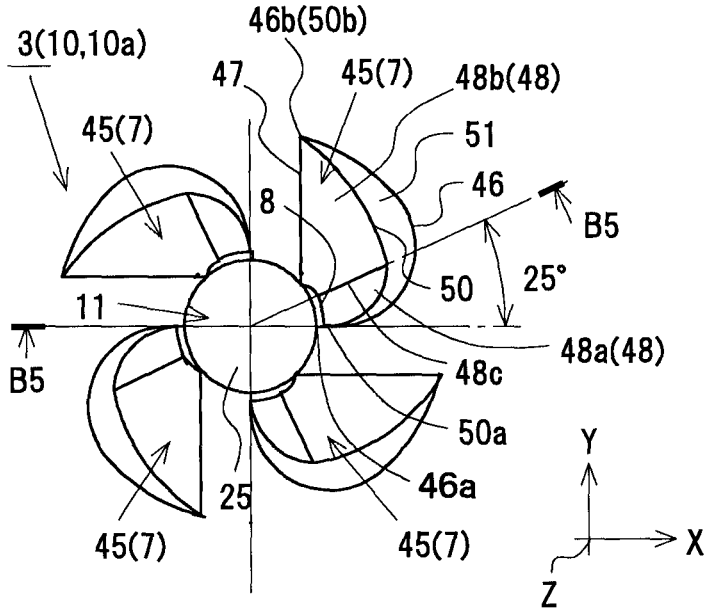
(b)
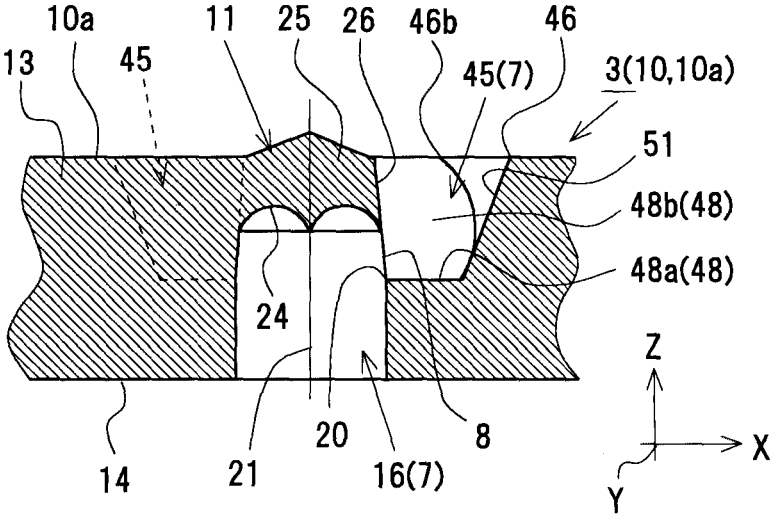
Fig. 1 0

(a)
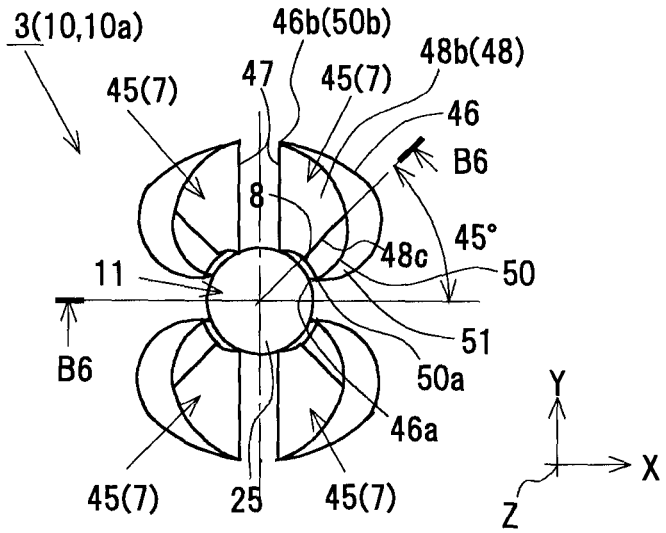
(b)
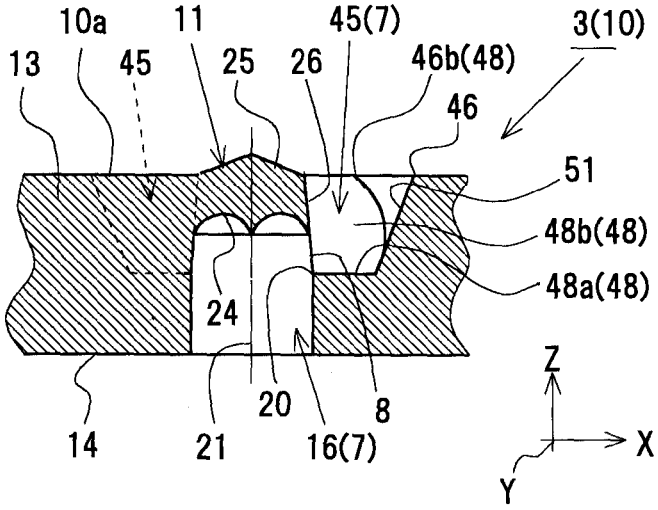
Fig. 1 1

(a)
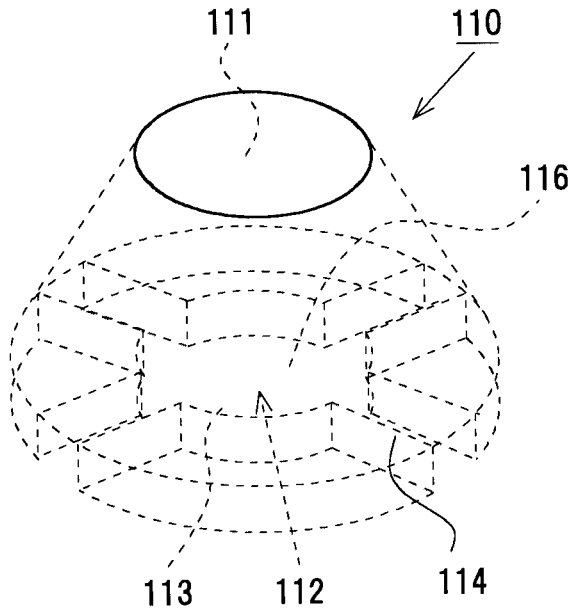
(b)
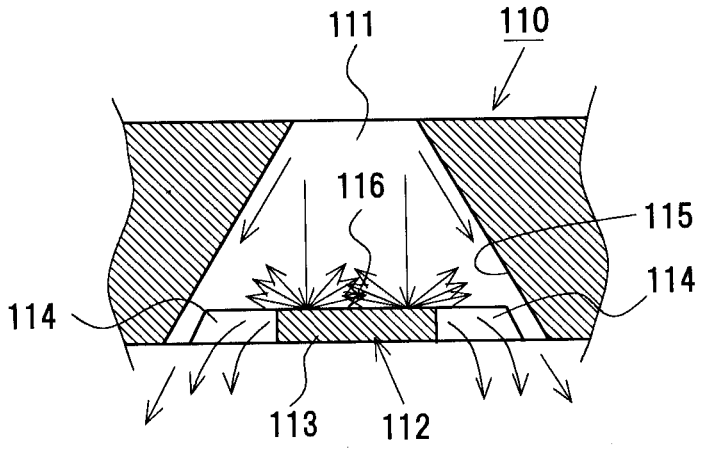
Fig. 1 3 PRIOR ART

NOZZLE PLATE FOR FUEL INJECTION DEVICE

BACKGROUND OF THE INVENTION

1. Field of the Invention

The present invention relates to a nozzle plate for a fuel injection device which is mounted on a fuel injection port of the fuel injection device, and injects fuel flowed out from the fuel injection port after atomizing the fuel.

2. Related Art

An internal combustion engine (hereinafter abbreviated as "engine") of an automobile or the like is configured such that a combustible mixed gas is formed by mixing fuel injected from a fuel injection device and air introduced into the engine through an intake pipe, and the combustible mixed gas is burned in the inside of the cylinder. It has been known that, in such an engine, a mixing state of fuel injected from the fuel injection device and air largely influences the performance of the engine. Particularly, it has been known that the atomization of the fuel injected from the fuel injection device becomes an important factor which influences the performance of the engine.

First Example of Related Art

FIG. 12 shows a nozzle plate 102 mounted on a fuel injection port 101 of a fuel injection device 100. The nozzle plate 102 is formed such that a nozzle hole 103 having a quadrangular shape as viewed in a plan view is gradually increased from the one end side to the other end side in the plate thickness direction, and the nozzle plate 102 is mounted in the fuel injection port 101 of the fuel injection device 100 such that one end side in the plate thickness direction is positioned on a fuel injection port 101 side of the fuel injection device 100. Further, in the nozzle plate 102, an interference element 105 is formed on a nozzle hole opening edge 104 on the other end side in the plate thickness direction, and the interference element 105 is configured to partially close the nozzle hole 103.

In the fuel injection device 100 provided with such a nozzle plate 102, when fuel flows out from the fuel injection port 101, misty fuel F2 which impinges on the interference element 105 and flows along a surface of the interference element 105 impinges on fuel F1 which flows along an inner wall surface 106 of the nozzle hole 103, and fuels F1 and F2 are atomized and are injected into the inside of an intake pipe from the nozzle hole 103 (see JP-A-10-122097).

Second Example of Related Art

A nozzle plate of related art 110 shown in FIG. 13 is configured such that fuel injected from a fuel injection port 101 of a fuel injection device 100 flows into a nozzle hole 111 (see FIG. 13). With respect to the nozzle hole 111 of the nozzle plate 110, the shape of the nozzle hole 111 along the flow direction of fuel is formed into a frustoconical shape such that a hole diameter of the nozzle hole 111 on a fuel outlet side is larger than the hole diameter of the nozzle hole 111 on a fuel inlet side. Further, with respect to the nozzle plate 110, an interference element 112 on which fuel flowing in the inside of the nozzle hole 111 impinges is formed in the vicinity of the fuel outlet side and between the fuel outlet side and the fuel inlet side. The interference element 112 is configured such that a circular disk-shaped plate portion 113 is formed on an inner side of an outlet-side opening edge of the nozzle hole 111 by way of a plurality of beam-like support portions 114.

In the nozzle plate of related art 110 shown in FIG. 13, fuel flowed into the inside of the nozzle hole 111 from the fuel inlet side mainly impinges on the plate portion 113 of the interference element 112 so that kinetic energy of fuel is converted into energy for atomizing fuel whereby fuel which flows in the inside of the nozzle hole 111 is atomized, and the atomized fuel is injected to the outside (for example, the inside of an intake pipe) from the fuel outlet side (see JP-A-2004-239142).

SUMMARY OF THE INVENTION

However, the nozzle plates 102, 110 shown in FIG. 12 and FIG. 13 are insufficient with respect to the atomization of the fuel injected from the nozzle hole 103, 111.

That is, with respect to fuel which is injected from the fuel injection port 101 of the fuel injection device 100 and flows into the inside of the nozzle hole 103, 111 of the nozzle plate 102, 110, a portion of the fuel which flows into the inside of the nozzle hole 103, 111 impinges on the interference element 105, 112 so that the portion of the fuel is reflected at random whereby the portion of the fuel is atomized. At the same time, the portion of fuel also generates flow of the fuel along a fuel impinging surface 108, 116 of the interference element 105, 112. Then, the portion of the fuel impinges on a remaining portion of the fuel which flows along the inclined inner wall surface 106 or a tapered surface 115 of the nozzle hole 103, 111. However, the portion of the fuel which impinges on the interference element 105, 112 is reflected at random and, at the same time, flows along the fuel impinging surface 108, 116 which forms a plane approximately orthogonal to the flow direction of the fuel. Accordingly, the portion of the fuel cannot sufficiently obstruct the flow of the remaining portion of the fuel which flows along the inclined inner wall surface 106 or the tapered surface 115 of the nozzle hole 103, 111 and directly flows out from the fuel outlet side of the nozzle hole 113, 111 without impinging on the interference element 105, 112 and hence, the fuel which flows in the inside of the nozzle hole 103,111 cannot be sufficiently atomized.

Accordingly, it is an object of the present invention to provide a nozzle plate for a fuel injection device which can inject fuel flowed out from a fuel injection port of the fuel injection device in a sufficiently atomized state.

As shown in FIG. 1 to FIG. 11, the present invention relates to a nozzle plate 3 for a fuel injection device which is mounted on a fuel injection port 4 of a fuel injection device 1, and has a nozzle hole 7 through which fuel injected from the fuel injection port 4 passes. In such a nozzle plate 3 for a fuel injection device, the nozzle hole 7 is a hole formed in a nozzle plate body 10. By partially closing an outlet-side opening portion 20 which forms an opening portion on a fuel flow-out side by an interference element 11, an orifice 8 which throttles flow of the fuel is formed. The nozzle plate body 10 and the interference element 11 are integrally formed by cooling and solidifying a molten material filled into the inside of a cavity 33. Further, a surface 24 of the interference element 11 on which a portion of fuel which flows in the inside of the nozzle hole 7 impinges is an annular recessed surface which faces toward an upstream side in the flow direction of the fuel which flows in the inside of the nozzle 7 and can impart kinetic energy which returns the flow of the fuel to the upstream side in the flow direction of the fuel. The surface 24 of the interference element 11 forms the fuel which passes through the nozzle hole 7 into a turbulent flow; and sharply bends the flow of a portion of a fuel which passes through the nozzle hole 7 such that the flow of the portion of the fuel flows backward, to thereby make the flow of the portion of the fuel impinge on fuel which intends to advance straightly through the nozzle hole 7 and the orifice 8 and form the flow of the fuel into a turbulent flow, such that the fuel which passes through the orifice 8 can be easily atomized in air.

According to the nozzle plate for a fuel injection device of the present invention, a portion of fuel which flows in the inside of the nozzle hole is formed into a turbulent flow by impinging on the interference element, is sharply bent so as to flow backward by the impinging surface of the interference element, which is an annular recessed surface, and is made to impinge on fuel which intends to advance straightly and pass through the nozzle hole and the orifice, thereby forming the flow of the fuel which intends to advance straightly and pass through the nozzle hole and the orifice into a turbulent flow. As a result, the nozzle plate for a fuel injection device according to the present invention can further enhance the level of the atomization of fuel compared to a nozzle plate of related art.

BRIEF DESCRIPTION OF DRAWINGS

FIG. 9(*a*) and FIG. 9(*b*) are views showing an essential part of a nozzle plate for a fuel injection device according to a second embodiment of the present invention, and are also views corresponding to FIG. 4(*a*) and FIG. 4(*b*), wherein FIG. 9(*a*) is a partial plan view of the nozzle plate for a fuel injection device, and FIG. 9(*b*) is a cross-sectional view taken along a line B4-B4 in FIG. 9(*a*);

FIG. 10(*a*) and FIG. 10(*b*) are views showing an essential part of a nozzle plate for a fuel injection device according to a third embodiment of the present invention, and are also views corresponding to FIG. 3(*a*) to FIG. 3(*c*), wherein FIG. 10(*a*) is a partial plan view of the nozzle plate for a fuel injection device, and FIG. 10(*b*) is a cross-sectional view taken along a line B5-B5 in FIG. 10(*a*);

FIG. 11(*a*) and FIG. 11(*b*) are views showing an essential part of a nozzle plate for a fuel injection device according to a fourth embodiment of the present invention, and are also views corresponding to FIG. 3(*a*) to FIG. 3(*c*), wherein FIG. 11(*a*) is a partial plan view of the nozzle plate for a fuel injection device, and FIG. 11(*b*) is a cross-sectional view taken along a line B6-B6 in FIG. 11(*a*);

FIG. 13(*a*) and FIG. 13(*b*) are views showing a portion (nozzle hole and an area in the vicinity of the nozzle hole) of a nozzle plate according to a second example of related art which is mounted on a fuel injection port of a fuel injection device, wherein FIG. 13(*a*) is a perspective view of the nozzle hole and the area in the vicinity of the nozzle hole of the nozzle plate according to the second example of related art, and FIG. 13(*b*) is a longitudinal cross-sectional view of the nozzle hole and the area in the vicinity of the nozzle hole of the nozzle plate according to the second example of related art.

PREFERRED EMBODIMENTS OF THE INVENTION

Embodiments of the present invention are described in detail by reference to drawings hereinafter.

First Embodiment

Fuel Injection Device

Figure 1:
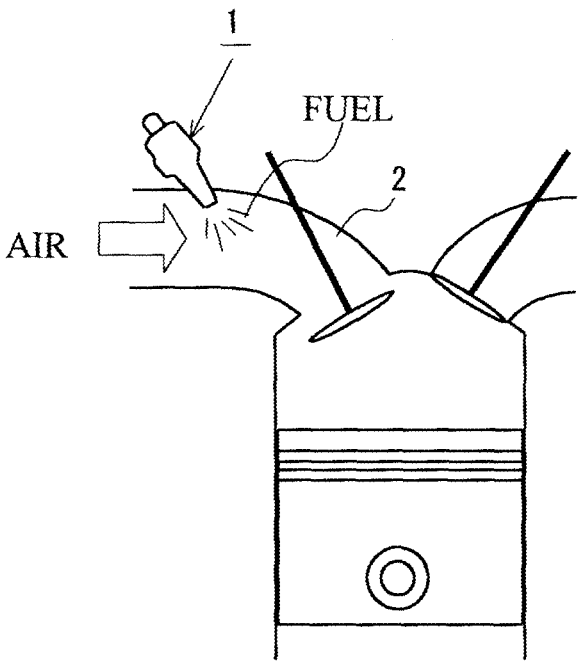
FIG. 1 is a view schematically showing an in-use state of a fuel injection device on which a nozzle plate for a fuel injection device according to a first embodiment of the present invention is mounted.
Figure 2:
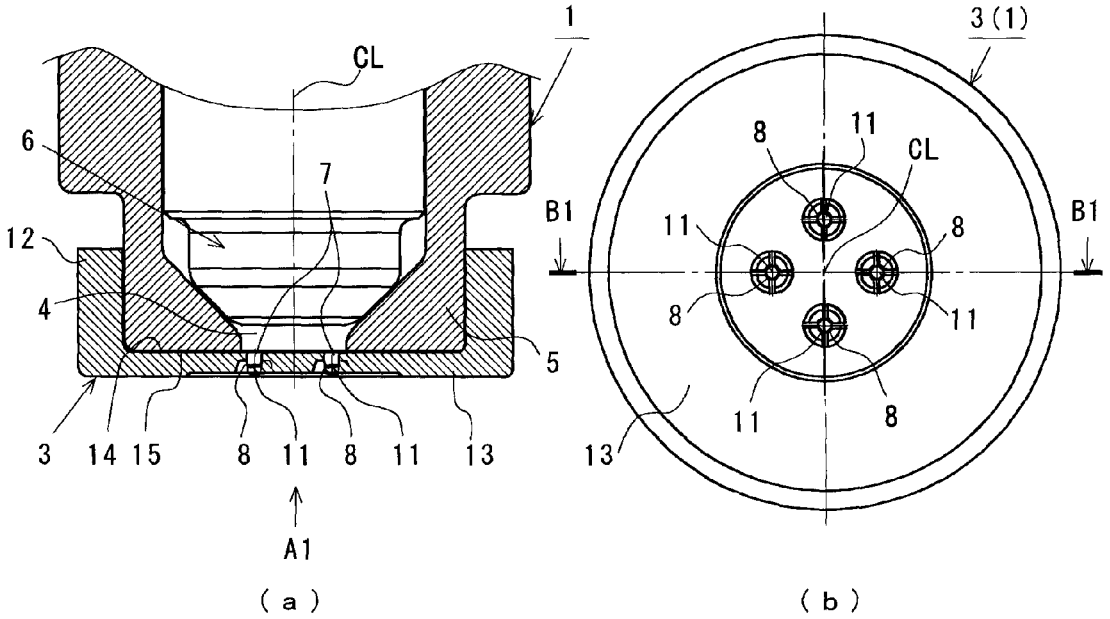
FIG. 2(*a*) and FIG. 2(*b*) are views showing a distal end side of the fuel injection device on which the nozzle plate for a fuel injection device according to the first embodiment of the present invention is mounted, wherein FIG. 2(*a*) is a longitudinal cross-sectional view (a cross-sectional view taken along a line B1-B1 in FIG. 2(*b*)) of the distal end side of the fuel injection device, and FIG. 2(*b*) is a lower surface view (a view as viewed from the direction A1 in FIG. 2(*a*) and showing a distal end surface of the fuel injection device) of the distal end side of the fuel injection device.

FIG. 1 is a view schematically showing an in-use state of a fuel injection device 1 on which a nozzle plate for a fuel injection device according to a first embodiment of the present invention is mounted (see FIG. 2). As shown in FIG. 1, the fuel injection device 1 of a port injection method is mounted in a middle portion of an intake pipe 2 of an engine, and is configured to form a combustible mixed gas by injecting fuel into the inside of the intake pipe 2 and mixing air and the fuel introduced into the intake pipe 2.

FIG. 2(*a*) and FIG. 2(*b*) are views showing a distal end side of the fuel injection device 1 on which the nozzle plate 3 for a fuel injection device (hereinafter abbreviated as nozzle plate), wherein FIG. 2(*a*) is a longitudinal cross-sectional view (a cross-sectional view taken along a line B1-B1 in FIG. 2(*b*)) of the distal end side of the fuel injection device 1, and FIG. 2(*b*) is a lower surface view (a view as viewed from the direction A1 in FIG. 2(*a*) and showing a distal end surface of the fuel injection device 1) of the distal end side of the fuel injection device 1.

As shown in FIG. 2(*a*) and FIG. 2(*b*), in the fuel injection device 1, the nozzle plate 3 is mounted on a distal end side of a valve body 5 in which a fuel injection port 4 is formed. In such a fuel injection device 1, a needle valve 6 is opened or closed by a solenoid not shown in the drawing. When the needle valve 6 is opened, fuel in the inside of the valve body 5 is injected from the fuel injection port 4, and fuel injected from the fuel injection port 4 is injected to the outside after passing through nozzle holes 7 and orifices 8 formed in the nozzle plate 3.

<Nozzle Plate>

Figure 3:
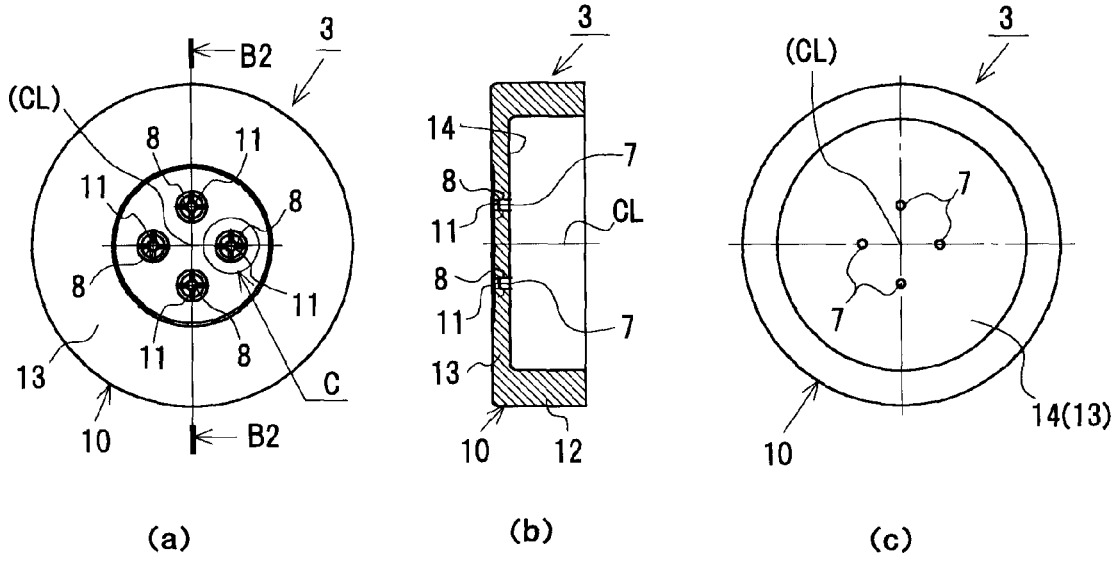
FIG. 3(*a*) to FIG. 3(*c*) are views showing the nozzle plate, wherein FIG. 3(*a*) is a plan view of the nozzle plate, FIG. 3(*b*) is a cross-sectional view of the nozzle plate taken along a line B2-B2 in FIG. 3(*a*), and FIG. 3(*c*) is a back surface view of the nozzle plate.
Figure 4:
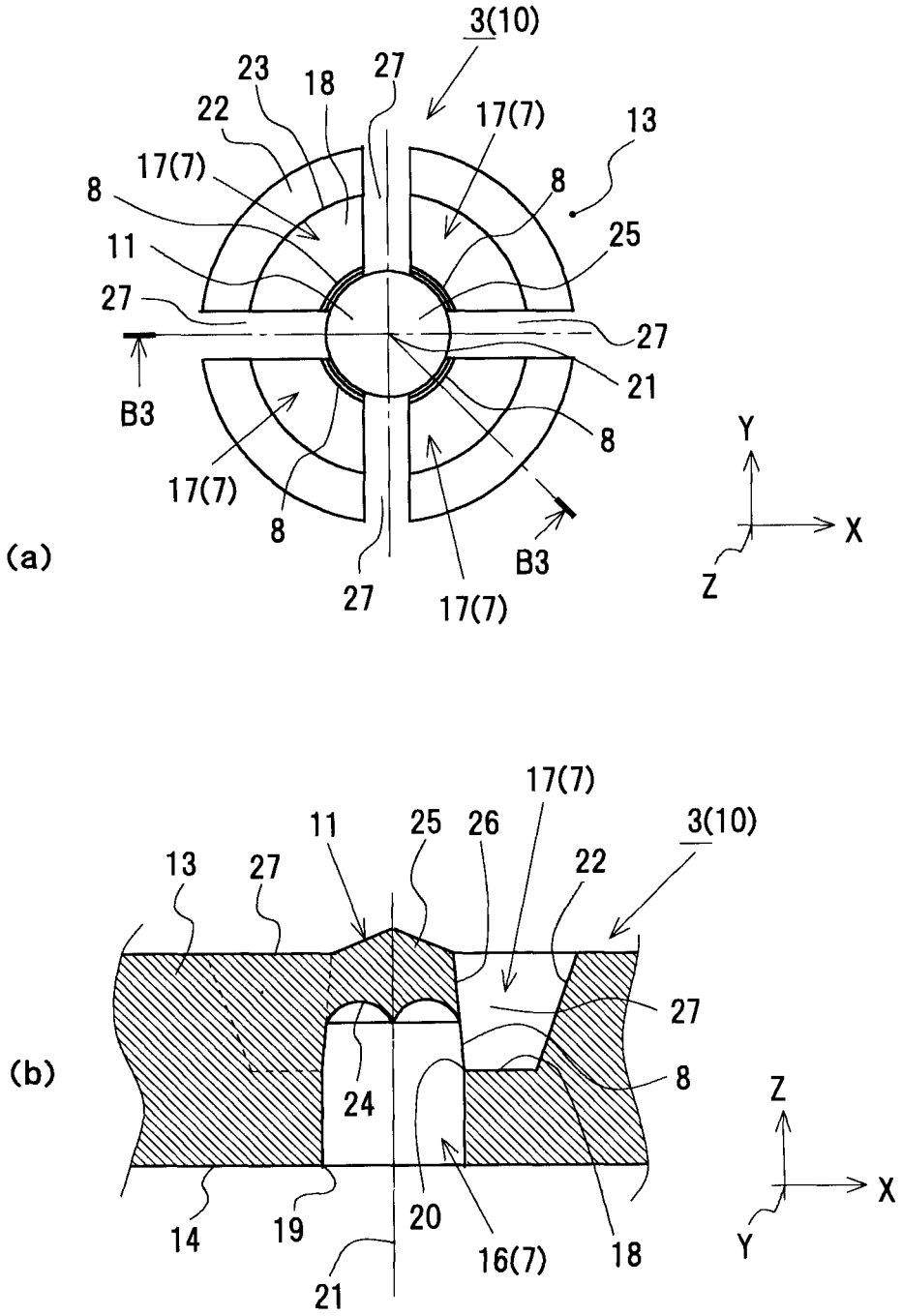
FIG. 4(*a*) and FIG. 4(*b*) are enlarged views of a portion C in FIG. 3(*a*), wherein FIG. 4(*a*) is a partial plan view of the nozzle plate for a fuel injection device, and FIG. 4(*b*) is a cross-sectional view taken along a line B3-B3 in FIG. 4(*a*)

Hereinafter, the nozzle plate 3 according to this embodiment is explained by difference to FIG. 2 to FIG. 4. FIG. 3(*a*) is a plan view of the nozzle plate 3, FIG. 3(*b*) is a cross-sectional view of the nozzle plate 3 taken along a line B2-B2 in FIG. 3(*a*), and FIG. 3(*c*) is a back surface view of the nozzle plate 3. FIG. 4(*a*) is an enlarged view of a portion C shown in FIG. 3(*a*) (a partial plan view of the nozzle plate 3), and FIG. 4(*b*) is a cross-sectional view of the nozzle plate 3 taken along a line B3-B3 in FIG. 4(*a*).

As shown in FIG. 2 to FIG. 4, the nozzle plate 3 includes a nozzle plate body 10 and a plurality of interference elements 11. The nozzle plate body 10 is a bottomed cylindrical body made of a synthetic resin material (for example, PPS, PEEK, POM, PA, PES, PEI, LCP) which is constituted of a circular cylindrical wall portion 12 and a bottom wall portion 13 which is integrally formed with one end side of the circular cylindrical wall portion 12. The circular cylindrical wall portion 12 of the nozzle plate body 10 is fitted on an outer periphery of the valve body 5 on a distal end side without a gap, and is fixed to the valve body 5 in a state where an inner surface 14 of the bottom wall portion 13 is brought into contact with a distal end surface 15 of the valve body 5. A plurality of (four) nozzle holes 7 which make the fuel injection port 4 of the valve body 5 and the outside communicate with each other are formed in the bottom wall portion 13 of nozzle plate body 10 at equal intervals around a center axis CL of the valve body 5.

The nozzle hole 7 formed in the nozzle plate body 10 is constituted of a straight round-hole-shaped first nozzle hole 16 orthogonal to the inner surface 14 of the bottom wall portion 13, and a second nozzle hole 17 which communicates with the first nozzle hole 16 and is concentric with the first nozzle hole 16. The first nozzle hole 16 is formed in the nozzle plate body 10 such that the first nozzle hole 16 is positioned on a fuel injection port 4 side when the nozzle plate 3 is mounted on a distal end side of the valve body 5. One end of the first nozzle hole 16 constitutes a fuel inlet side opening portion 19 which opens in the inner surface 14 of the bottom wall portion 13, and the other end of the first nozzle hole 16 constitutes n outlet-side opening portion 20 which opens in the bottom surface 18 of the second nozzle hole 17. The second nozzle hole 17 is a frustoconical-shaped recess in an imaginary planner cross-section including the center axis 21 of the first nozzle hole 16, and is constituted of a bottom surface 18 orthogonal to the center axis 21 of the first nozzle hole 16, a tapered surface 22 which expands toward an outer surface 10*a* of the nozzle plate body 10 from the bottom surface 18. The bottom surface 18 of the second nozzle hole 17 is formed outside the outlet-side opening portion 20 of the first nozzle hole 16 in the radial direction and is also formed orthogonal to the center axis 21 of the first nozzle hole 16. An outer diameter size of the bottom surface 18 is set larger than a diameter of the first nozzle hole 16. The tapered surface 22 of the second nozzle hole 17 is formed along an outer periphery 23 of the bottom surface 18 so as to expand the flow passage of fuel toward a downstream side in the flow direction of fuel. When fuel which passes through the orifice 8 impinges on the tapered surface 22 of the second nozzle 17, the tapered surface 22 turns the flow of impinged fuel into a turbulent flow. Then, the flow of fuel which is formed into a thin film after passing through the orifice 8 and the second nozzle hole 17 is atomized by being injected to the outside of the nozzle plate 3, and the atomized fuel is widely spread in the inside of the intake pipe 2 (see FIG. 1).

The interference element 11 is disposed in the inside of the second nozzle hole 17, and is formed so as to partially close the outlet-side opening portion 20 of the first nozzle hole 16. The interference element 11 includes: a rod-shaped-body portion 25 having an impingement surface 24 on which a portion of fuel which flows out from the outlet-side opening portion 20 of the first nozzle hole 16 impinges; and support leg portions 27 which constitute plate-shaped ribs formed on the periphery of the rod-shaped-body portion 25 at four positions equidistantly such that the support leg portions 27 connect portions of an outer peripheral surface 26 of the rod-shaped-body portion 25 with portions of the bottom surface 18 and the tapered surface 22 of the second nozzle hole 17.

In the rod-shaped-body portion 25, the outer peripheral surface 26 is formed into a tapered surface for imparting a draft angle (for example, a draft angle of 5°) to the outer peripheral surface 26. The impingement surface 24 on which fuel impinges is formed on the rod-shaped-body portion 25 at a position away from the outlet-side opening portion 20 of the first nozzle hole 16 by a predetermined size (for example, a size determined by taking into account an opening area of the orifice 8). The impingement surface 24 is an annular recessed surface which is formed by forming a recess having an arcuate cross section which faces toward an upstream side of the flow direction of fuel flowing in the inside of the first nozzle hole 16 and can generate kinetic energy for returning the flow of fuel to an upstream side in the fuel flow direction (can generate a backward flow) circumferentially about the center axis 21 of the first nozzle hole 16. A distal end portion of the rod-shaped-body portion 25 projects in a cone shape so as to ensure a large wall thickness of the rod-shaped-body portion 25 and a strength of the rod-shaped-body portion 25.

Radially inner-side portions of the support leg portions 27 are formed along the generating line direction of the rod-shaped-body portion 25, and connect portions of the outer peripheral surface 26 of the rod-shaped-body portion 25 and portions of the outlet-side opening portion 20 of the first nozzle hole 16 to each other. A width size of the support leg portion 27 is decided by taking into account a support strength for supporting the rod-shaped-body portion 25 or the like. The support leg portions 27 are formed equidistantly at four positions around the rod-shaped-body portion 25 thus dividing the second nozzle hole 17 in four. The respective portions formed by dividing the second nozzle hole 17 in four have an approximately sector shape as viewed in a plan view.

In the interference element 11 having such rod-shaped-body portion 25 and the support leg portions 27, the orifice 8 which throttles the flow of fuel flowed out from the outlet-side opening portion 20 of the first nozzle hole 16 is formed between the support leg portions 27, 27 arranged adjacent to each other and between the impingement surface 24 of the rod-shaped-body portion 25 and the bottom surface 18 of the second nozzle hole 17. The orifices 8 are formed equidistantly at 4 positions around the center axis 21 of the first nozzle hole 16. To allow the orifices 8 to have an optimum opening area for atomization of fuel, sizes and the like of the respective portions (a size between the support leg portions 27, 27 arranged adjacent to each other (a size in the circumferential direction about the center axis 21 of the first nozzle hole 16), a size between the impingement surface 24 of the rod-shaped-body portion 25 and the bottom surface 18 of the second nozzle hole 17 (a size in the direction along the center axis 21 of the first nozzle hole 16)) are decided. Such orifices 8 are formed along the tapered outer peripheral surface 26 of the rod-shaped-body portion 25 and hence, when the nozzle plate 3 is viewed in a plan view as shown in FIG. 4(*a*), opening portions of the orifices 8 are visually recognized. That is, with respect to fuel which flows in the inside of the first nozzle hole 16, although a portion of the fuel impinges on the impingement surface 24 of the interference element 11, there is a possibility that a remaining portion of the fuel advances straightly and passes through the orifices 8 and the second nozzle hole 17 without impinging on the interference element 11. In view of the above, the nozzle plate 3 of this embodiment is configured such that the impingement surface 24 which is the annular recessed surface formed on the interference element 11 rapidly bends a portion of the flow of fuel flowed out from the outlet-side opening portion 20 of the first nozzle hole 16, thus making the portion of the flow of fuel flow backward, and the portion of the fuel which is made to flow backward impinges on the fuel which intends to advance straightly and pass through the orifices 8. That is, the flow of the fuel which intends to advance straightly and pass through the first nozzle hole 16 and the orifices 8 is formed into a turbulent flow by the fuel which is made to flow backward by the impingement surface 24 of the interference element 11.

[Injection Molding Die]

Figure 5:
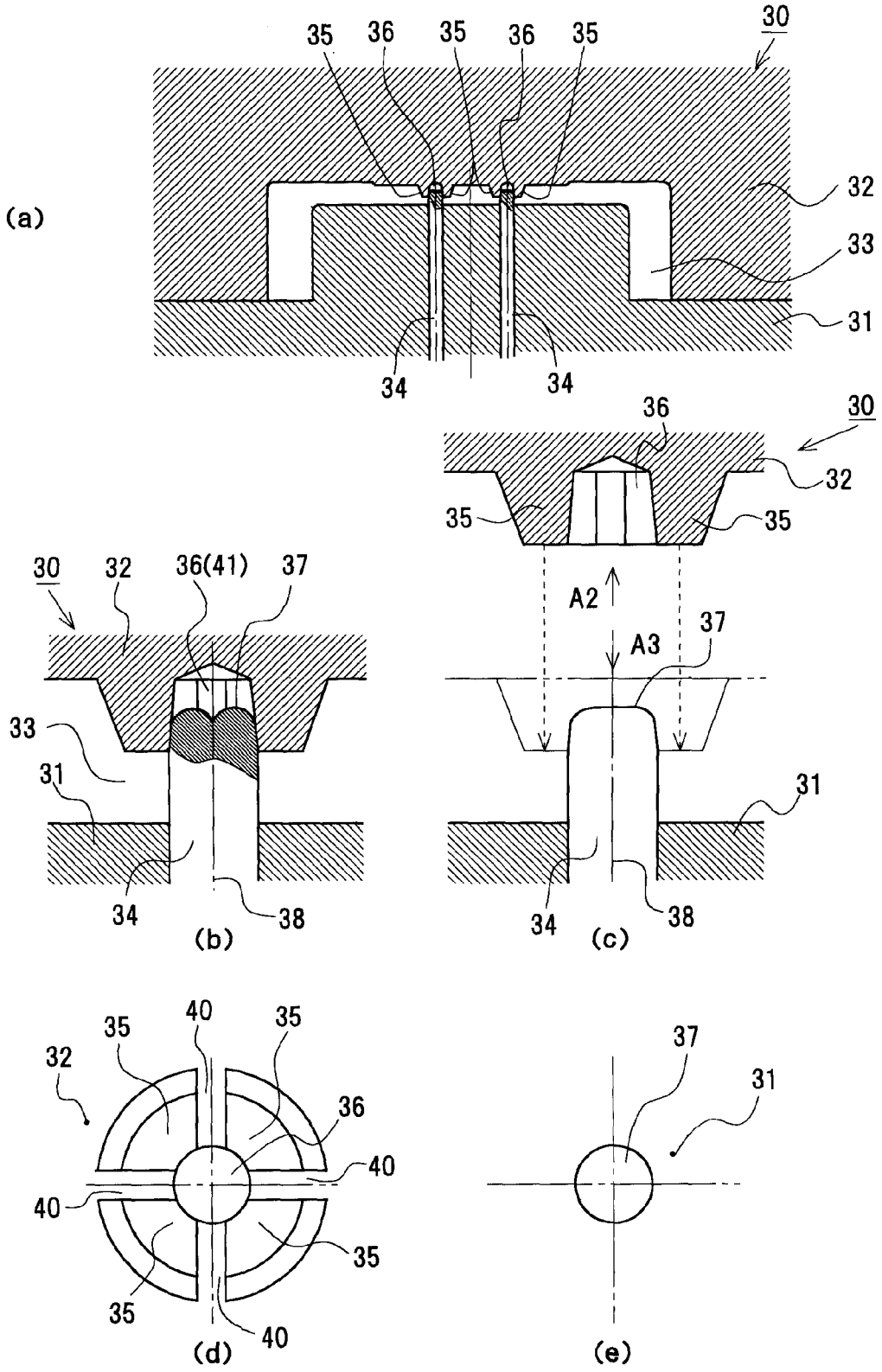
FIG. 5(*a*) to FIG. 5(*e*) are views showing the structure of an injection molding die used for forming the nozzle plate for a fuel injection device by injection molding, wherein FIG. 5(*a*) is a longitudinal cross-sectional view of the injection molding die, FIG. 5(*b*) is a view showing a portion in FIG. 5(*a*) in an enlarged manner, FIG. 5(*c*) is an enlarged view showing a portion of the mold at the time of removing the die, FIG. 5(*d*) is a partial plan view of a second die as viewed from the direction A2 in FIG. 5(*c*), and FIG. 5(*e*) is a partial plan view of a first die as viewed from the direction A3 in FIG. 5(*c*)

FIG. 5(*a*) to FIG. 5(*e*) are views showing the structure of an injection molding die 30 used for forming the nozzle plate 3 by injection molding, wherein FIG. 5(*a*) is a longitudinal cross-sectional view of the injection molding die 30 at the time of fastening the die, FIG. 5(*b*) is a view showing a portion in FIG. 5(*a*) in an enlarged manner, FIG. 5(*c*) is an enlarged view showing a portion of the injection molding die 30 at the time of removing the die, FIG. 5(*d*) is a partial plan view of a second die 32 as viewed from the direction A2 in FIG. 5(*c*), and FIG. 5(*e*) is a partial plan view of a first die 31 as viewed from the direction A3 in FIG. 5(*c*).

As shown in FIGS. 5(*a*) to 5(*e*), in the injection molding die 30, a cavity 33 is formed between the first die 31 and the second die 32. FIG. 5(*a*) shows a shape of the cavity 33 corresponding to a cross-sectional shape of the nozzle plate 3 shown in FIG. 3(*b*). In the explanation made hereinafter, since the nozzle holes 7 at four positions are equal and hence, only a nozzle hole forming portion at one position in the injection molding die 30 is explained.

First nozzle hole forming pins 34 for forming the first nozzle holes 16 are accommodated in the first die 31 in a state where the first nozzle hole forming pins 34 project into the inside of the cavity 33. In a state where the first die 31 and the second die 32 are fastened to each other, first nozzle hole forming pins 34 are engaged with a rod-shaped-body portion forming recessed portions (spaces) 36 formed inside four second nozzle hole forming projections 35 of the second die 32 in the radial direction, respectively. An annular projection 37 for forming the annular recessed portion which constitutes the impingement surface 24 of the interference element 11 is formed on a distal end side of the first nozzle hole forming pin 34. The annular projection 37 is a ring-shaped projection which is formed such that a projection having an arcuate cross section in an imaginary plane which includes a center axis 38 of the first nozzle hole forming pin 34 is formed circumferentially around the center axis 38 of the first nozzle hole forming pin 34.

On a side of a surface of the second die 32 on which a portion of the cavity 33 is formed, the rod-shaped-body portion forming recessed portion 36 for forming the rod-shaped-body portion 25 of the nozzle plate 3 is formed, and four second nozzle hole forming projections 35 are arranged equidistantly around the rod-shaped-body portion forming recessed portion 36. Spaces 40 each of which is formed between the second nozzle hole forming projections 35, 35 of the second die 32 arranged adjacent to each other are communicated with the inside of the rod-shaped-body portion forming recessed portion 36, and the space 40 formed between the second nozzle hole forming projections 35, 35 becomes a portion which is used for forming the support leg portion 27.

When these first die 31 and second die 32 are fastened to each other, the first nozzle hole forming pins 34 of the first die 31 are fitted into the inside of the rod-shaped-body portion forming recessed portions 36 of the second die 32, thus forming spaces for forming the rod-shaped-body portions 25 between distal ends of the first nozzle hole forming pins 34 and bottom surfaces of the rod-shaped-body portion forming recessed portions 36. The spaces for forming the rod-shaped-body portions 25 are communicated with the inside of the cavity 33 through the spaces 40 each of which is formed between the second nozzle hole forming projections 35, 35 arranged adjacent to each other. Accordingly, when a synthetic resin material in a molten state is injected into the inside of the cavity 33 through gates not shown in the drawing, the synthetic resin material in a molten state flows into spaces 41 for forming the rod-shaped-body portions 25 formed in the inside of the rod-shaped-body portion forming recessed portions 36 through the spaces 40 each of which is formed between the second nozzle hole forming projections 35, 35 arranged adjacent to each other, thus forming the nozzle plate 3 shown in FIG. 3(*a*) to FIG. 3(*c*). The synthetic resin material in a molten state does not flow into contact portions between the outer peripheral surfaces 26 of the first nozzle hole forming pins 34 and the second nozzle hole forming projections 35 thus forming the orifices 8.

Manner of Operation and Advantageous Effects of First Embodiment

According to the nozzle plate 3 of this embodiment having the above-mentioned structure, a portion of fuel which flows in the inside of the first nozzle hole 16 impinges on the interference element 11 and hence, the portion of the fuel is formed into a turbulent flow and, at the same time, the portion of the fuel is rapidly bent by the impingement surface 24 which constitutes the annular recessed surface of the interference element 11 to flow backward, and is made to impinge on fuel which intends to advance straightly and pass through the nozzle hole 7 and the orifices 8, thus forming the flow of the fuel which intends to advance straightly and pass through the nozzle hole 7 and the orifices 8 into a turbulent flow. As a result, the nozzle plate according to this embodiment can further improve the level of atomization of fuel compared to the nozzle plate of related art.

Modification 1 of First Embodiment

Figure 6:
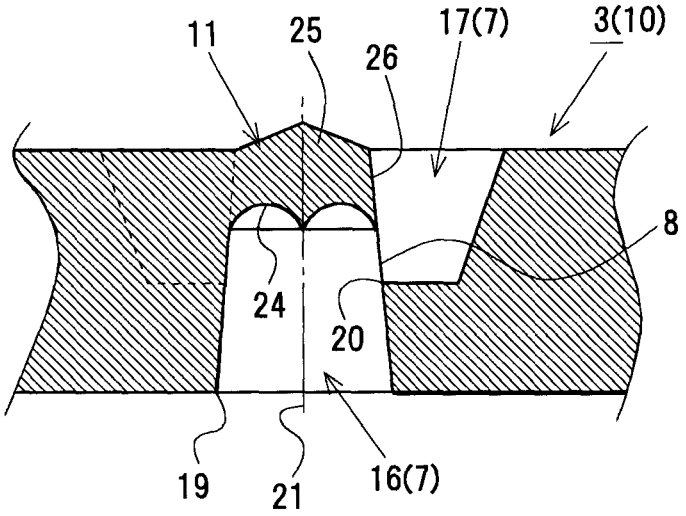
FIG. 6 is a view showing a modification 1 of the nozzle plate according to the first embodiment, and also is a view corresponding to FIG. 4B.

FIG. 6 is a view showing the modification 1 of the nozzle plate 3 according to the first embodiment, and is also a view corresponding to FIG. 4B.

In the nozzle plate 3 according to the modification shown in FIG. 6, a first nozzle hole 16 is formed into a tapered hole where a hole diameter of the first nozzle hole 16 at a fuel inlet side opening portion 19 is larger than the hole diameter of the first nozzle hole 16 at an outlet-side opening portion 20. A taper angle of the first nozzle hole 16 is set approximately equal to a taper angle of an outer peripheral surface 26 of a rod-shaped-body portion 25. To the contrary, in the nozzle plate 3 according to the first embodiment, the first nozzle hole 16 is formed into a circular hole where a hole diameter of the first nozzle hole 16 is equal between the fuel inlet side opening portion 19 and the outlet-side opening portion 20. In this manner, the nozzle plate 3 according to this modification differs from the nozzle plate 3 according to the first embodiment in that the first nozzle hole 16 is formed of the tapered hole.

According to the nozzle plate 3 of this modification, the first nozzle hole 16 is formed of the tapered hole where a cross-sectional area of a flow passage is gradually decreased toward a downstream side from an upstream side in the flow direction of fuel. Accordingly, the flow of the fuel which flows in the inside of the first nozzle hole 16 impinges on an impingement surface 24 after being converged toward a center axis of the first nozzle hole 16, where a flow speed of the fuel which impinges on the impingement surface 24 is increased. As a result, the fuel is subject to the further larger kinetic energy in the backward flow direction on impinging on the impingement surface 24, thus forming the flow of the fuel into a turbulent flow more effectively.

Further, according to the nozzle plate 3 of this modification, the first nozzle hole 16 is a tapered hole and hence, an injection molding die 30 can be easily manufactured. Further, after the injection molding is completed, the nozzle plate 3 can be easily removed from the injection molding die 30 (see FIG. 5(*a*) to FIG. 5(*e*)).

Modification 2 of First Embodiment

Figure 7:
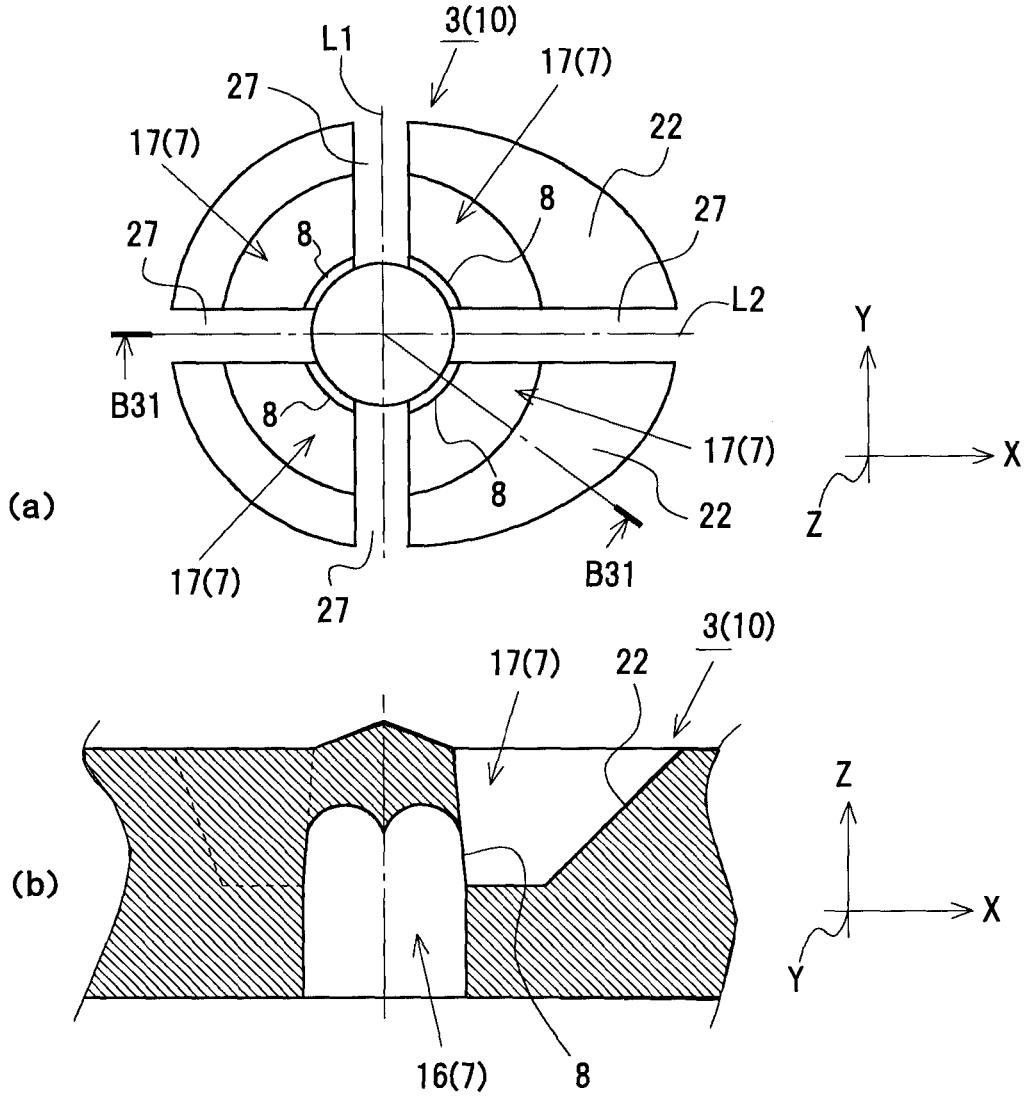
FIG. 7(*a*) and FIG. 7(*b*) are views showing a modification 2 of the nozzle plate according to the first embodiment, wherein FIG. 7(*a*) is a view corresponding to FIG. 4(*a*), and FIG. 7(*b*) is a cross-sectional view taken along a line B31-B31 in FIG. 7(*a*) (a view corresponding to a FIG. 4(*b*))

FIG. 7(*a*) and FIG. 7(*b*) are views showing a modification 2 of the nozzle plate 3 according to the first embodiment, wherein FIG. 7(*a*) is a view corresponding to FIG. 4(*a*), and FIG. 7(*b*) is a cross-sectional view taken along a line B31-B31 in FIG. 7(*a*) (a view corresponding to FIG. 4(*b*)).

As shown in FIG. 7, the nozzle plate 3 according to this embodiment is configured such that a tapered surface 22 of a second nozzle 17 in a first quadrant and a fourth quadrant of a X-Y coordinate plane has an inclination angle thereof gradually decreased toward a center line L2 side along an X axis from a center line L1 side along a Y axis so that the nozzle plate 3 is opened widely toward the direction along the X axis.

According to the nozzle plate 3 of this modification, it is possible to set a fuel injection direction and a fuel injection range which are different from a fuel injection direction and a fuel injection range applied for the nozzle plate 3 of the first embodiment. That is, according to the nozzle plate 3 of this modification, the variation of the fuel injection can be increased so that the fuel injection can be optimized.

Other Modifications

Figure 8:
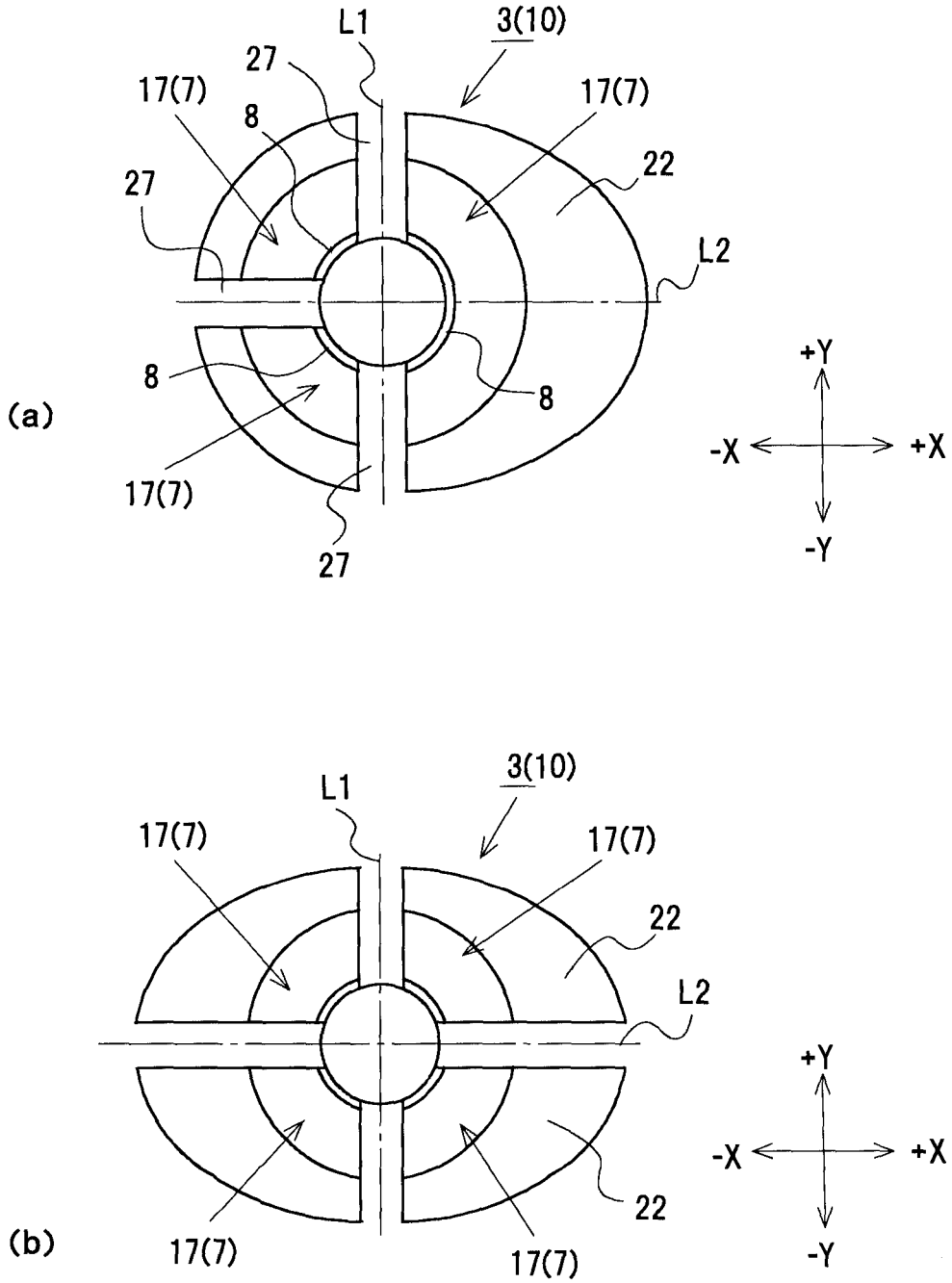
FIG. 8(*a*) and FIG. 8(*b*) are views showing a further modification of the nozzle plate according to the modification 2 shown in FIG. 7(*a*) and FIG. 7(*b*)
Figure 12:
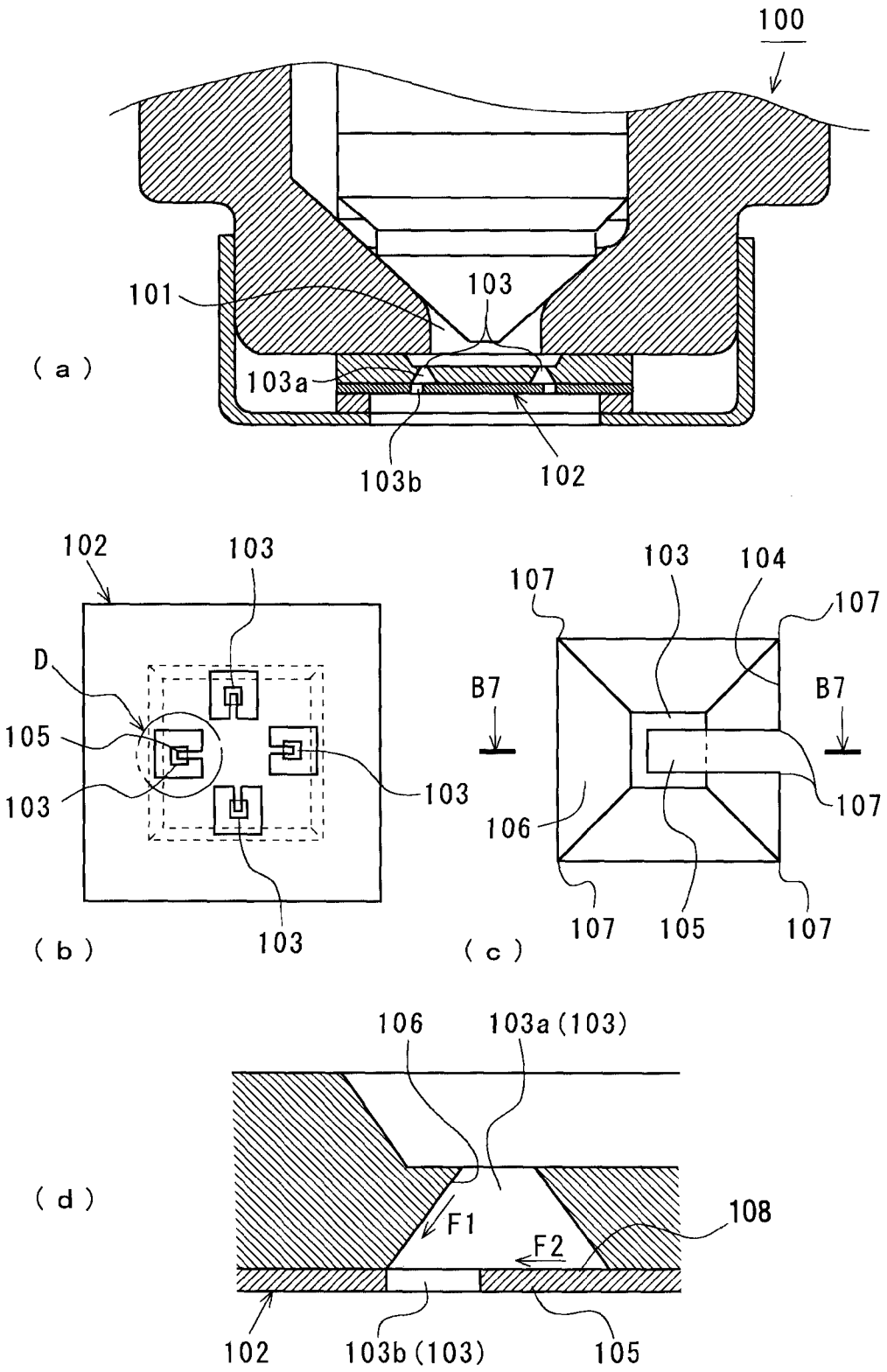
Fig. 12 PRIOR ART
FIG. 12(*a*) to FIG. 12(*d*) are views showing a nozzle plate according to a first example of related art which is mounted in a fuel injection port of a fuel injection device, wherein FIG. 12(*a*) is a cross-sectional view of a distal end side of the fuel injection device on which the nozzle plate of the first example of related art is mounted, FIG. 12(*b*) is a plan view of the nozzle plate of the first example of related art, FIG. 12(*c*) is an enlarged view of a portion D (a partial plan view of the nozzle plate) in FIG. 12(*b*), and FIG. 12(*d*) is a cross-sectional view taken along a line B7-B7 in FIG. 12(*c*)

FIG. 8(*a*) and FIG. 8(*b*) are views showing a further modification of the nozzle plate 3 according to the modification 2 shown in FIG. 7(*a*) and FIG. 7(*b*).

That is, the nozzle plate 3 shown in FIG. 8(*a*) has a shape where a support leg portion 27 which partitions a second nozzle hole 17 in the first quadrant and a second nozzle hole 17 in the fourth quadrant in the nozzle plate 3 shown in FIG. 7(*a*) and FIG. 7(*b*) is omitted. Such a nozzle plate 3 can increase a fuel injection amount in the direction along an X axis.

In the nozzle plate 3 shown in FIG. 8(*b*), a second nozzle hole 17 in a second quadrant is formed in a shape which is in line symmetry with (an axis of symmetry being a center line L1 along a Y axis) a shape of the second nozzle hole 17 in the first quadrant of the nozzle plate 3 shown in FIG. 7(*a*) and FIG. 7(*b*), a second nozzle hole 17 in a third quadrant is formed in a shape which is in line symmetry with (an axis of symmetry being the center line L1 along the Y axis) a shape of the second nozzle hole 17 in the fourth quadrant of the nozzle plate 3 shown in FIG. 7(*a*) and FIG. 7(*b*), the shape of the second nozzle hole 17 in the first quadrant and the shape of the second nozzle hole 17 in the second quadrant are line symmetry with each other, and the shape of the second nozzle hole 17 in the third quadrant and the shape of the second nozzle hole 17 in the fourth quadrant are line symmetry with each other. Such a nozzle plate 3 can increase a fuel injection amount in the direction along a +X direction and a fuel injection amount in the direction along a −X direction.

Further, the nozzle plate 3 may adjust the fuel injection direction by suitably changing the degree of inclination of a tapered surface 22 of the second nozzle hole 17.

Still further, the nozzle plate 3 may displace a center axis of the second nozzle hole 17 with respect to a center axis of the first nozzle hole 16.

Second Embodiment

FIG. 9(*a*) and FIG. 9(*b*) are views showing an essential part of a nozzle plate 3 according to the second embodiment of the present invention. Constitutional parts of the nozzle plate 3 according to this embodiment which are common with the constitutional parts of the nozzle plate 3 according to the first embodiment are given the same symbols, and the explanation of the nozzle plate 3 according to the second embodiment which overlaps with the explanation of the nozzle plate 3 of the first embodiment is omitted.

As shown in FIG. 9(*a*) and FIG. 9(*b*), in the nozzle plate 3 according to this embodiment, a pair of second nozzle holes 45 is formed in left-and-right symmetry with respect to a Y axis (see FIG. 9(*a*) particularly). With respect to a shape of the second nozzle hole 45 as viewed in a plan view, an outer edge shape (a shape of a nozzle plate body 10 on an outer surface 10*a*) is formed of: an arcuate outer edge portion 46 which has one end 46*a* thereof positioned on an X axis and the other end 46*b* thereof positioned in the vicinity of the Y axis; and a straight-line outer edge portion 47 which extends from the other end 46*b* of the arcuate outer edge portion 46 to a rod-shaped body portion 25 of an interference element 11 along the Y axis. A bottom surface 48 of the second nozzle hole 45 has: a first bottom surface portion 48*a* which is orthogonal to a center axis 21 of a first nozzle hole 16; and a second bottom surface portion 48*b* which constitutes an inclined surface which is obliquely raised from an end portion of the first bottom surface portion 48*a* to the straight-line outer edge portion 47 by cutting. The bottom surface 48 of the second nozzle hole 45 is formed such that one end 50*a* of an arcuate bottom surface outer edge 50 is positioned in the vicinity of one end 46*a* of the arcuate outer edge portion 46, and the other end 50*b* of the arcuate bottom surface outer edge 50 coincides with the other end 46*b* of the arcuate outer edge portion 46. The second nozzle hole 45 is formed such that the bottom surface 48 and the arcuate outer edge portion 47 are connected to each other by way of an inclined side surface 51. The inclined side surface 51 is formed such that a flow passage area of the second nozzle hole 45 is expanded toward the outer surface 10*a* of the nozzle plate body 10 from the bottom surface 48. With respect to the bottom surface 48 of the second nozzle hole 45, a boundary portion 48*c* between the first bottom surface portion 48*a* and the second bottom surface portion 48*b* is formed such that an imaginary line extending from the boundary portion 48*c* passes the center of the first nozzle hole 16 and makes an angle of 25° with respect to the X axis. An orifice 8 is formed within a range from an intersecting point between the straight-line outer edge portion 47 and a rod-shaped-body portion 25 to an intersecting point between the arcuate outer edge portion 46 and the rod-shaped-body portion 25.

The nozzle plate 3 according to this embodiment having such structure can acquire, as a matter of course, advantageous effects substantially equal to the advantageous effects acquired by the nozzle plate 3 according to the first embodiment. Further, in the nozzle plate 3 according to this embodiment, the flow of fuel flowed out from the orifice 8 is guided along the bottom surface 48 and the inclined side surface 51 of the second nozzle hole 45 and hence, swirling energy is imparted to fuel which flows in the inside of the second nozzle hole 45, whereby a spiral flow of fuel is generated around the center axis 21 of the first nozzle hole 16. As a result, according to the nozzle plate 3 of this embodiment, the flows of fuels which are flowed out from the pair of second nozzle holes 45, 45 arranged in an opposedly facing manner are mixed together in a complicated manner while impinging on each other and hence, the degree of atomization of fuel can be further enhanced compared to the nozzle plate 3 of the first embodiment. In the nozzle plate 3 of this embodiment, fuel is injected in two directions from the second nozzle holes 45 arranged at two positions.

Third Embodiment

FIG. 10(*a*) and FIG. 10(*b*) are views showing an essential part of a nozzle plate 3 according to the third embodiment of the present invention. Constitutional parts of the nozzle plate 3 according to this embodiment which are common with the constitutional parts of the nozzle plates 3 according to the first and second embodiments are given the same symbols, and the explanation of the nozzle plate 3 according to the third embodiment which overlaps with the explanation of the nozzle plates 3 of the first and second embodiments is omitted.

As shown in FIG. 10(*a*) and FIG. 10(*b*), in the nozzle plate 3 according to this embodiment, second nozzle holes 45 are formed in a windmill shape at four positions. The second nozzle hole 45 in a first quadrant on an X-Y coordinate plane shown in FIG. 9(*a*) is formed in first to fourth quadrants respectively such that the respective second nozzle holes 45 generate a spiral flow of fuel in the same direction around a center axis 21 of a first nozzle hole 16.

The nozzle plate 3 according to this embodiment having such structure can acquire, as a matter of course, advantageous effects substantially equal to the advantageous effects acquired by the nozzle plate 3 according to the first embodiment. Further, in the nozzle plate 3 according to this embodiment, swirling energy in the same direction is imparted to fuel which flows in the second nozzle holes 45 at four positions and hence, a spiral flow of fuel twisted in the same direction is generated around the center axis 21 of the first nozzle hole 16. As a result, according to the nozzle plate 3 of this embodiment, the flows of fuels which are flowed out from the second nozzle holes 45 at four positions are mixed together in a complicated manner and hence, the degree of atomization of fuel can be further enhanced compared to the nozzle plate 3 of the first embodiment. In the nozzle plate 3 of this embodiment, fuel is injected in four directions from the second nozzle holes 45 arranged at four positions.

Fourth Embodiment

FIG. 11(*a*) and FIG. 11(*b*) are views showing an essential part of a nozzle plate 3 according to the fourth embodiment of the present invention. Constitutional parts of the nozzle plate 3 according to this embodiment which are common with the constitutional parts of the nozzle plates 3 according to the first to third embodiments are given the same symbols, and the explanation of the nozzle plate 3 according to the fourth embodiment which overlaps with the explanation of the nozzle plates 3 of the first to third embodiments is omitted.

The nozzle plate 3 according to this embodiment is configured such that the pair of second nozzle holes 45, 45 according to the second embodiment are formed in symmetry with respect to an X axis.

Further, in the nozzle plate 3 according to this embodiment, on an X-Y coordinate plane, the second nozzle hole 45 in a first quadrant and the second nozzle hole 45 in a fourth quadrant are arranged away from the X axis by a predetermined size, and the second nozzle hole 45 in a second quadrant and the second nozzle hole 45 in a third quadrant are arranged away from the X axis by a predetermined size.

Further, in the nozzle plate 3 according to this embodiment, a boundary portion 48*c* between a first bottom surface portion 48*a* and a second bottom surface portion 48*b* of each second nozzle hole 45 is formed such that an imaginary line extending from the boundary portion 48*c* passes the center of a first nozzle hole 16 and makes an angle of 45° with respect to the X axis.

The nozzle plate 3 according to this embodiment having such structure can acquire, as a matter of course, advantageous effects substantially equal to the advantageous effects acquired by the nozzle plate 3 according to the first embodiment. Further, in the nozzle plate 3 according to this embodiment, the flow of fuel flowed out from an orifice 8 is guided along a bottom surface 48 and an inclined side surface 51 of the second nozzle hole 45 and hence, swirling energy is imparted to the fuel which flows in the inside of the second nozzle hole 45, whereby a spiral flow of fuel is generated around a center axis 21 of a first nozzle hole 16. As a result, according to the nozzle plate 3 of this embodiment, the flow of fuels which are flowed out from the pair of second nozzle holes 45, 45 arranged in an opposedly facing manner in the first quadrant and the second quadrant and the flow of fuels which are flowed out from the pair of second nozzle holes 45, 45 arranged in an opposedly facing manner in the third quadrant and the fourth quadrant are mixed together in a complicated manner while impinging on each other and hence, the degree of atomization of fuel can be further enhanced compared to the nozzle plate 3 of the first embodiment. In the nozzle plate 3 of this embodiment, fuel is injected in four directions from the second nozzle holes 45 at four positions.

What is claimed is:

1. A nozzle plate for a fuel injection device, comprising:

a nozzle plate body; and an interference element, wherein:

the nozzle plate body and the interference element are formed as a single piece;

at least one nozzle hole is defined in the nozzle plate body;

the at least one nozzle hole is configured to receive fuel;

the at least one nozzle hole comprises an outlet-side opening portion at a fuel flow-out side of the nozzle plate body;

an orifice is defined by partially closing the outlet-side opening portion with the interference element;

the orifice is configured to throttle a flow of the fuel;

the interference element comprises an annular recessed surface facing an upstream side in a flow direction of the fuel;

the annular recessed surface is configured to return the flow of the fuel toward the upstream side in the flow direction of the fuel; and the annular recessed surface is configured to form the flow of the fuel into a turbulent flow.

2. The nozzle plate for a fuel injection device according to claim 1, wherein the at least one nozzle hole includes:

a first nozzle hole defined on a fuel receiving side of the nozzle plate body, and having the outlet-side opening portion; and a second nozzle hole defined in the nozzle plate body such that the second nozzle hole is configured to communicate with the outlet-side opening portion of the first nozzle hole through the orifice, and is configured to guide the fuel to an outside of the nozzle plate.

3. The nozzle plate for a fuel injection device according to claim 2, wherein the annular recessed surface is formed such that a recess having an arcuate cross section is formed circumferentially around a center axis of the first nozzle hole.

4. The nozzle plate for a fuel injection device according to claim 2, wherein the second nozzle hole is configured to guide the flow of the fuel such that the fuel flows spirally around a center axis of the first nozzle hole.

5. The nozzle plate for a fuel injection device according to claim 3, wherein the second nozzle hole is configured to guide the flow of the fuel such that the fuel flows spirally around the center axis of the first nozzle hole.

6. The nozzle plate for a fuel injection device according to claim 1, wherein the nozzle plate is mounted on a fuel injection port of a fuel injection device, and the at least one nozzle hole is configured to receive the fuel from the fuel injection port.

7. A fuel injection device comprising the nozzle plate according to claim 1.

8. The nozzle plate for a fuel injection device according to claim 1, wherein the nozzle plate body and the interference element are formed by cooling and solidifying a molten material filled into an inside of a cavity.

9. The nozzle plate for a fuel injection device according to claim 1, wherein the annular recessed surface is configured to impart kinetic energy so as to return the flow of the fuel toward the upstream side in the flow direction of the fuel.

10. The nozzle plate for a fuel injection device according to claim 1, wherein the annular recessed surface is configured to form the flow of the fuel into the turbulent flow by sharply bending the flow of a portion of the fuel such that the flow of the portion of the fuel flows backward to thereby make the flow of the portion of the fuel impinge on another portion of the fuel flowing straightly toward the at least one nozzle hole and the orifice.

11. The nozzle plate for a fuel injection device according to claim 1, wherein the annular recessed surface is configured to form the flow of the fuel into the turbulent flow so as to increase atomization of the fuel in air.

* * * * *